US006374980B1

(12) United States Patent
Ishida et al.

(10) Patent No.: US 6,374,980 B1
(45) Date of Patent: Apr. 23, 2002

(54) COIN SORTING METHOD AND DEVICE

(75) Inventors: Takeshi Ishida, Sakado; Jun Yamada, Kawagoe, both of (JP)

(73) Assignee: Kabushiki Kaisha Nippon Conclux, Tokyo (JP)

( * ) Notice: Subject to any disclaimer, the term of this patent is extended or adjusted under 35 U.S.C. 154(b) by 0 days.

(21) Appl. No.: 09/673,681

(22) PCT Filed: Feb. 24, 2000

(86) PCT No.: PCT/JP00/01051

§ 371 Date: Oct. 19, 2000

§ 102(e) Date: Oct. 19, 2000

(87) PCT Pub. No.: WO00/51085

PCT Pub. Date: Aug. 31, 2000

(30) Foreign Application Priority Data

Feb. 24, 1999 (JP) ..... 11-046549

(51) Int. Cl.[7] ..... G07D 5/00; G07D 5/08

(52) U.S. Cl. ..... 194/328; 194/317

(58) Field of Search ..... 194/317, 318, 194/334, 328, 329, 330

(56) References Cited

U.S. PATENT DOCUMENTS

| | | | | | |
|---|---|---|---|---|---|
| 4,124,111 | A | * | 11/1978 | Hayashi | 194/102 |
| 5,002,174 | A | * | 3/1991 | Yoshihara | 194/317 |
| 5,033,603 | A | | 7/1991 | Kai et al. | 194/334 |
| 5,460,256 | A | | 10/1995 | Levasseur | 194/334 |
| 5,485,908 | A | | 1/1996 | Wang et al. | 194/317 |
| 5,507,379 | A | | 4/1996 | Mazur et al. | 194/318 |
| 6,082,518 | A | * | 7/2000 | Itako et al. | 194/317 |

FOREIGN PATENT DOCUMENTS

| | | | |
|---|---|---|---|
| GB | 2227347 | 7/1990 | G07F/3/02 |
| JP | 63079531 | 3/1988 | G07D/5/08 |
| JP | 63129985 | 5/1988 | G07D/5/08 |
| JP | 63-172391 | 7/1988 | G07D/5/08 |
| JP | 63-187385 | 8/1988 | G07D/5/08 |
| JP | 63-276188 | 11/1988 | G07D/5/08 |
| JP | 01090380 | 4/1989 | G07D/5/08 |
| JP | 04142742 | 6/1992 | G07D/5/02 |
| JP | 06215222 A | 1/1993 | G07D/5/08 |
| JP | 5-334517 | 12/1993 | G07D/5/02 |
| JP | 06194610 | 7/1994 | G07D/5/08 |
| JP | 6-215222 | 8/1994 | G07D/5/08 |
| JP | 09228780 | 7/1997 | G07D/5/02 |

* cited by examiner

*Primary Examiner*—Donald P. Walsh
*Assistant Examiner*—Mark J Beauchaine
(74) *Attorney, Agent, or Firm*—Welsh & Katz, Ltd.

(57) ABSTRACT

The pattern of a coin slotted through a coin slotting part (2) is recognized by a sensor part (3). The time during which the pattern is examined is measured by time measuring means (11). The measured time is compared with a judgment value stored in judgment value storage means (16) so as to check whether the coin is genuine.

6 Claims, 4 Drawing Sheets

COIN SORTING METHOD AND DEVICE

TECHNICAL FIELD

The present invention relates to a coin sorting method and a device, and more particularly to a coin sorting method and a device capable of preventing the acceptance of foreign coins, counterfeit coins and the like which have very similar materials and outer shapes to authentic ones.

BACKGROUND ART

Generally, a coin sorting device for use in automatic vending machines, money-changing machines, self-service machines and the like is configured to accept coins by sorting the coins slotted through a coin insertion slot into authentic ones and counterfeit ones and sorting the authentic coins according to the denominations.

Coins are sorted according to results obtained by detecting features such as material and outer shape of the coins by means of a sensor located on a coin passage for guiding the coins slotted through the coin insertion slot to a coin sorting part.

The sensor for detecting the features of the coins is, for example, a sensor which has a coil disposed on one side of the coin passage and forms an oscillation circuit including this coil. This sensor makes use of a change in inductance of the coil caused by the coins as they pass by the coil to detect a change in oscillation frequency, thereby obtaining information about the coins passed by the coil.

There is also another sensor which is configured to have an oscillation coil, which is excited by an exciting current having a predetermined frequency, disposed on one side of the coin passage and a reception coil disposed on the other side of the coin passage. This structure makes use of a change in mutual coupling factor (magnetic coupling factor) between the oscillation coil and the reception coil as the coins pass between the oscillation coil and the reception coil and detects a change in output voltage of the reception coil to obtain data about the coins passed between them.

The inductance and the mutual coupling factor which are variable as the coins pass between the coils as described above are different depending on the materials of coins. Therefore, the material of coins can be detected from the output of either of the above sensors. And, when the oscillation frequency or the exciting frequency is low, the material of the surface of the coin can be detected, and when the oscillation frequency or the exciting frequency is high, the material of the inside of the coin can be detected.

It is also possible to detect the outer shape of a coin by adjusting the position of the sensor disposed on the coin passage. This detection makes use of a difference in output depending on coins passing by the sensor with the sensor positioned at a predetermined height because the coins passing through the coin passage have a different height (area) depending on their diameters.

Conventional coin sorting devices generally have the aforesaid sensors in order to detect the material and outer shape of coins and are provided with a single or plurality of sensors for respective uses.

But, the conventional coin sorting devices identify slotted coins as authentic or counterfeit according to their material and outer shape and often accept foreign coins as authentic, because they have very similar material, and outer shape to authentic coins. Actually, many crimes are committed by taking advantage of such a weak point of the coin sorting devices these days.

DISCLOSURE OF THE INVENTION

In view of the circumstances described above, it is an object of the present invention to provide a coin sorting method and a device which can detect counterfeit coins such as foreign coins having very similar material, outer shape and the like to authentic ones.

To achieve the aforesaid object, the invention of claim 1 is a coin sorting method in which a sensor is disposed on a coin passage, features of coins rolling through the coin passage are detected by the sensor, the coins are identified as authentic or counterfeit on the basis of the detected results, the coins identified as authentic by the identification are accepted, and the coins identified as counterfeit by the identification are returned, characterized by:

measuring a feature detection time during which the sensor detects the features of the coins;

comparing the measured feature detection time with a predetermined time; and identifying the coins as authentic or counterfeit on the basis of the compared results.

The invention of claim 2 is the coin sorting method according to claim 1, wherein the output of the sensor is an output including change points which change from rising to falling and from falling to rising depending on a pattern of the coin, and the feature detection time is a time required between the detection of a first change point and the detection of a last change point among the change points.

The invention of claim 3 is the coin sorting method according to claim 1, wherein a ratio between a presence detection time during which the sensor detects the presence of the coin and the feature detection time is calculated, and the coin is identified as authentic or counterfeit according to the compared result between the calculated value and predetermined judgment values.

And, the invention of claim 4 is a coin sorting device having a sensor disposed on a coin passage, which detects features of coins rolling through the coin passage by the sensor, identifies the coins as authentic or counterfeit on the basis of the detected results, accepts the coins identified as authentic by the identification, and returns the coins identified as counterfeit by the identification, characterized in that the coin sorting device comprises:

feature sensing means for detecting the features of the coin on the basis of an output of the sensor;

time measuring means for measuring a feature detection time during which the feature sensing means detects the features of the coin; and comparison means for comparing the feature detection time measured by the time measuring means with a predetermined time.

The invention of claim 5 is the coin sorting device according to claim 4, wherein the output of the sensor is an output including change points which change from rising to falling and from falling to rising depending on a pattern of the coin;

the feature sensing means detects the change points from the output of the sensor; and the time measuring means measures a time required between the detection of a first change point and the detection of a last change point among the change points by the feature sensing means.

The invention of claim 6 is the coin sorting device according to claim 4, further comprising time ratio calculation means for calculating a ratio between a presence detection time during which the sensor detects the presence of the coin and the feature detection time, wherein the comparison means compares a value calculated by the time ratio calculation means with predetermined judgment values.

BEST MODE FOR CARRYING OUT THE INVENTION

One embodiment of the coin sorting method and its device to which the present invention pertains will be described with reference to the accompanying drawings.

Figure 1:
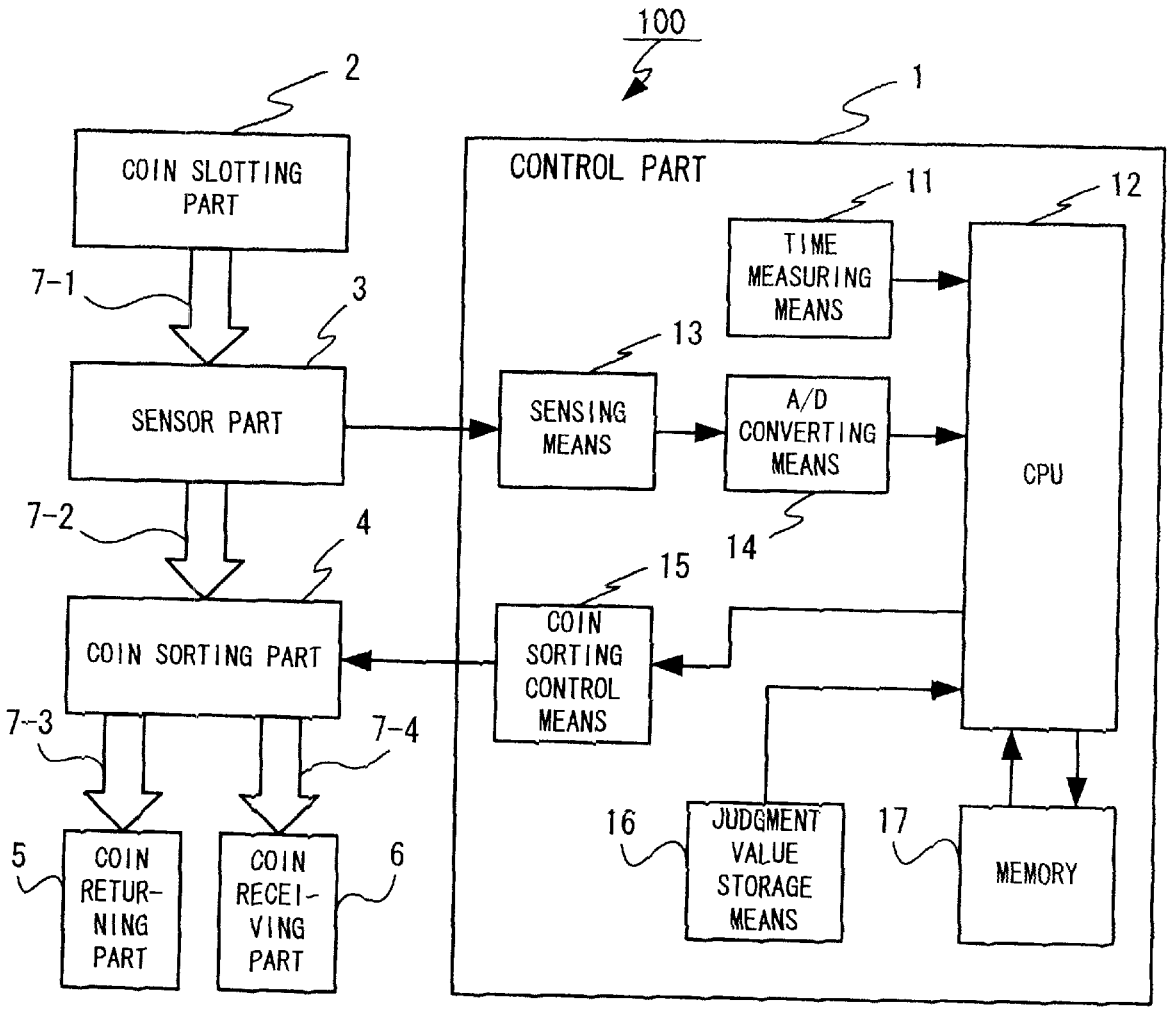
FIG. 1 is a block diagram showing a structure of a coin sorting device.

FIG. 1 is a block diagram showing a structure of the coin sorting device.

In FIG. 1, coin sorting device 100 comprises control part 1 for controlling the sorting of slotted coins, coin slotting part 2 as a coin insertion slot, sensor part 3 for detecting the features of coins, coin sorting part 4 for sorting the slotted coins according to the control part 1, coin returning part 5 for returning the slotted coins, coin receiving part 6 for receiving the slotted coins, and coin passages 7 (7-1, 7-2, 7-3, 7-4) through which the slotted coins travel.

The control part 1 comprises time measuring means 11 for measuring a time, CPU (central processing unit) 12 for performing a variety of processing to be described afterward, sensing means 13 for detecting information about coins from the detected results of the sensor part 3, A/D converting means 14 for converting information of an analogue signal detected by the sensing means 13 into information of a digital signal, coin sorting control means 15 for controlling the coin sorting part 4 on the basis of the result of authentic or counterfeit coin judged by the CPU 12, judgment value storage means 16 for storing judgment values required by the CPU 12 to identify coins as authentic or counterfeit, and memory 17 consisting of RAM for temporarily storing Information and the like and ROM that contains processing instructions and the like.

Now, a flow of coins slotted into the coin sorting device 100 will be described with reference to FIG. 2.

Figure 2:
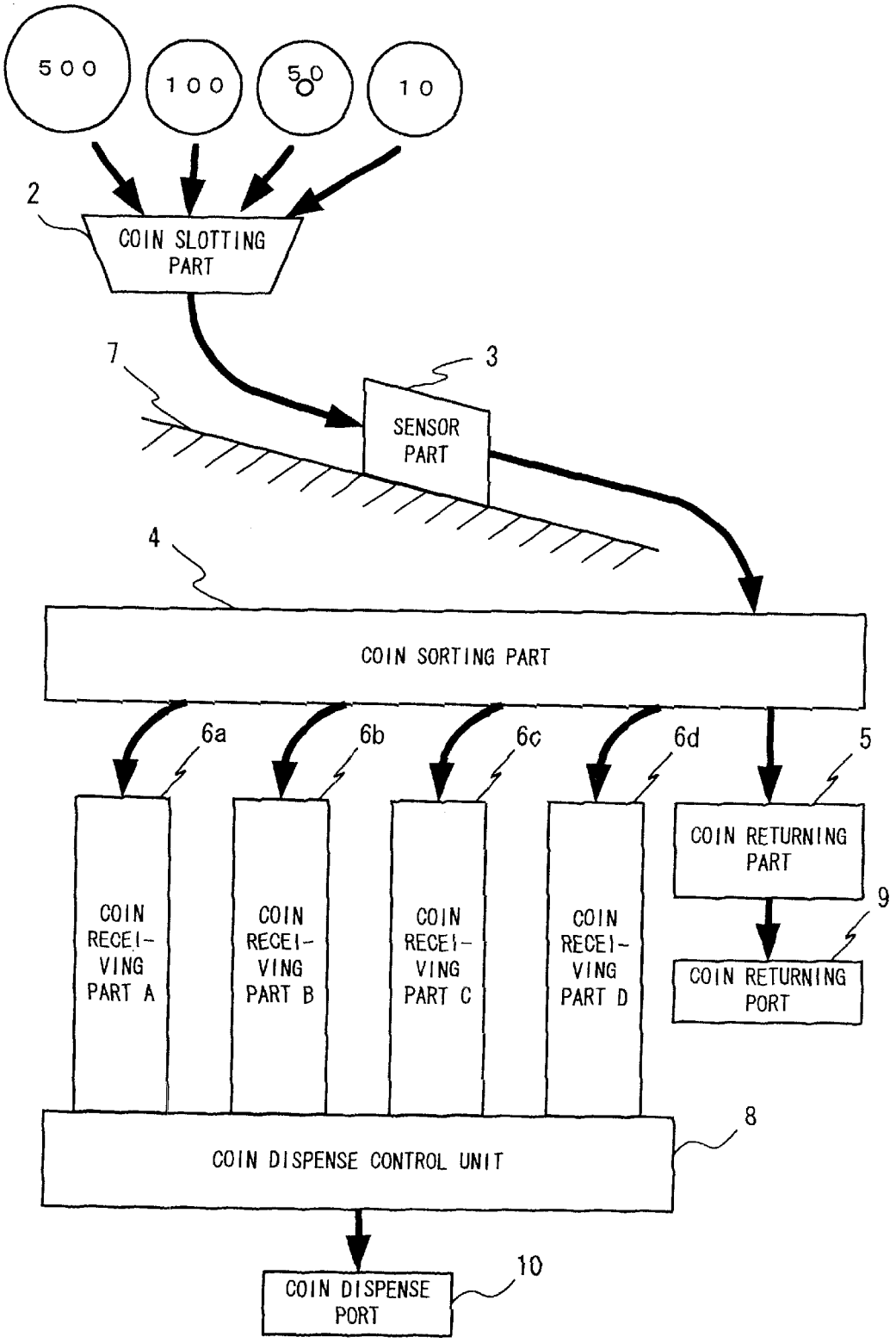
FIG. 2 is a schematic diagram showing a flow of coins in the coin sorting device.

FIG. 2 is a schematic diagram showing the flow of coins in the coin sorting device 100.

In the coin sorting device shown in FIG. 2, the coin receiving part 6 is divided into four coin receiving parts 6*a* to 6*d* (not shown in FIG. 1) to enable acceptance of the slotted coins by denomination.

Coin dispense control part 8 not shown in FIG. 1 is added so that the coins lodged in the coin receiving parts 6*a* to 6*d* can be dispensed.

Coins slotted through the coin slotting part 2 are guided to the coin sorting part 4 through the coin passage 7 and detected their features by the sensor part 3 on their way. The output of the sensor part 3 is entered the control part 1, which sorts the coins according to authentic or counterfeit and their denominations and controls the coin sorting part 4 according to the output of the sensor part 3.

The coin sorting part 4 sorts the coins conveyed through the coin passage 7 according to the control signal from the control part 1.

When a coin is judged as counterfeit by the control part 1, it is sorted toward coin returning part 5 and returned to a user through coin returning port 9 (not shown in FIG. 1).

When the coins are identified as authentic by the control part 1, they are sorted to the coin receiving part 6 and additionally sorted to any of the coin receiving parts 6*a* to 6*d* according to denomination.

The coins sorted into the coin receiving parts 6*a* to 6*d* are dispensed from coin dispense port 10 (not shown in FIG. 1) according to the control of the coin dispense control part 8 when change is dispensed or the like as required.

This coin sorting device 100 detects patterns and other features of coins by the sensor part 3.

Sensors (not shown) that the sensor part 3 has are the same as conventional ones.

Now, a method of detecting the surface patterns of the coins will be described.

To detect the surface pattern of a coin, the sensor part 3 detects the uneven surface pattern of the slotted coin, compares the detected pattern with a judgment reference pattern and also compares the pattern detection time with judgment values. The coin generally has a different pattern on its front and back surfaces. Since the coins roll along the coin passage 7 to enter the sensor part 3, there are an infinite number of uneven surface patterns to be detected by the sensor part 3.

But, even if there are infinite uneven surface patterns, it is considered that the detection data has some features when the same uneven pattern is detected.

A basic patterning process is performed to edit the output of the sensor part 3 into a basic pattern, which is then compared with the Judgment pattern, thereby enabling to detect the surface patterns of the coin.

Figure 3A:
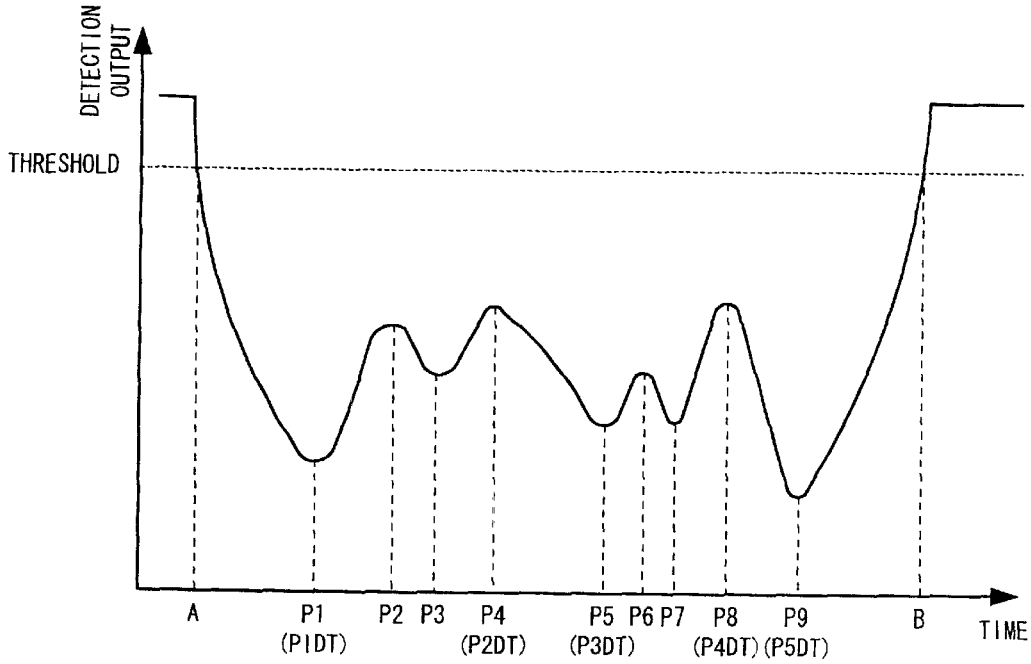
FIGS. 3(*a*) and 3(*b*) are diagrams showing output data of sensor part 3 and its basic patterned data.
Figure 3B:
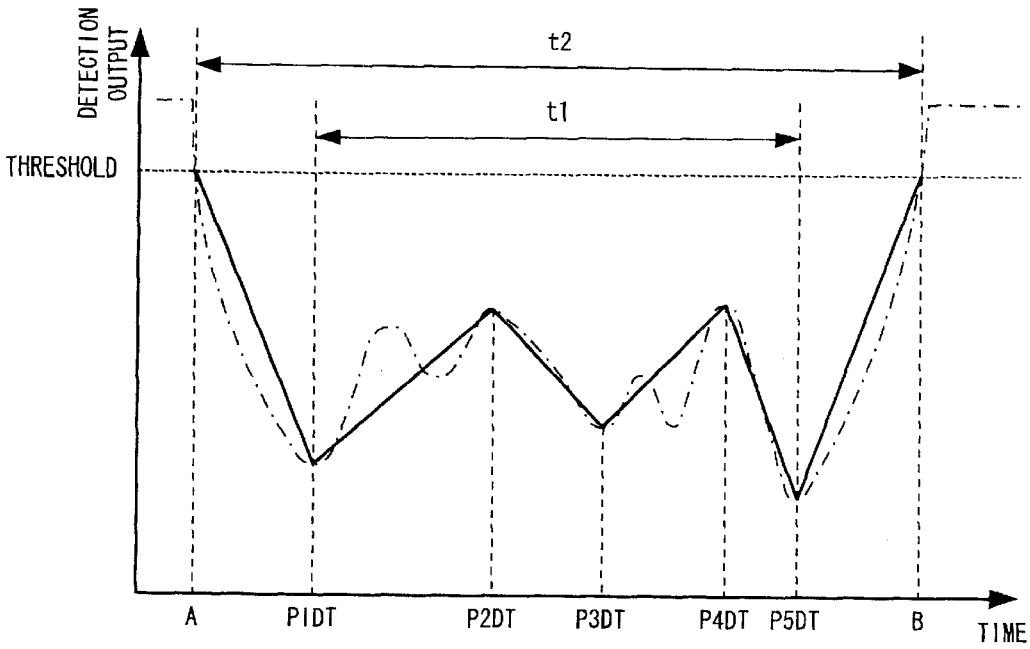

FIGS. 3(*a*) and 3(*b*) are diagrams showing output data of the sensor part 3 and its basic patterned data.

The output of the sensor part 3 has a waveform variable according to the surface uneven pattern of the coin as shown in FIG. 3(*a*). Points of change (inflection points), where the waveform changes from rising to falling or from falling to rising, are stored as data in the memory 17, time between the detection of the first point of change and the last point of change is determined, and the stored data is compiled into a predetermined quantity so to have a basic pattern of data. The quantity of data to be compiled is not particularly limited as far as it is an odd number, but it is determined to be five considering absorption of variations in data of individual coins.

Now, a method for data processing the detection output of the sensor part 3 will be described.

Figure 4:
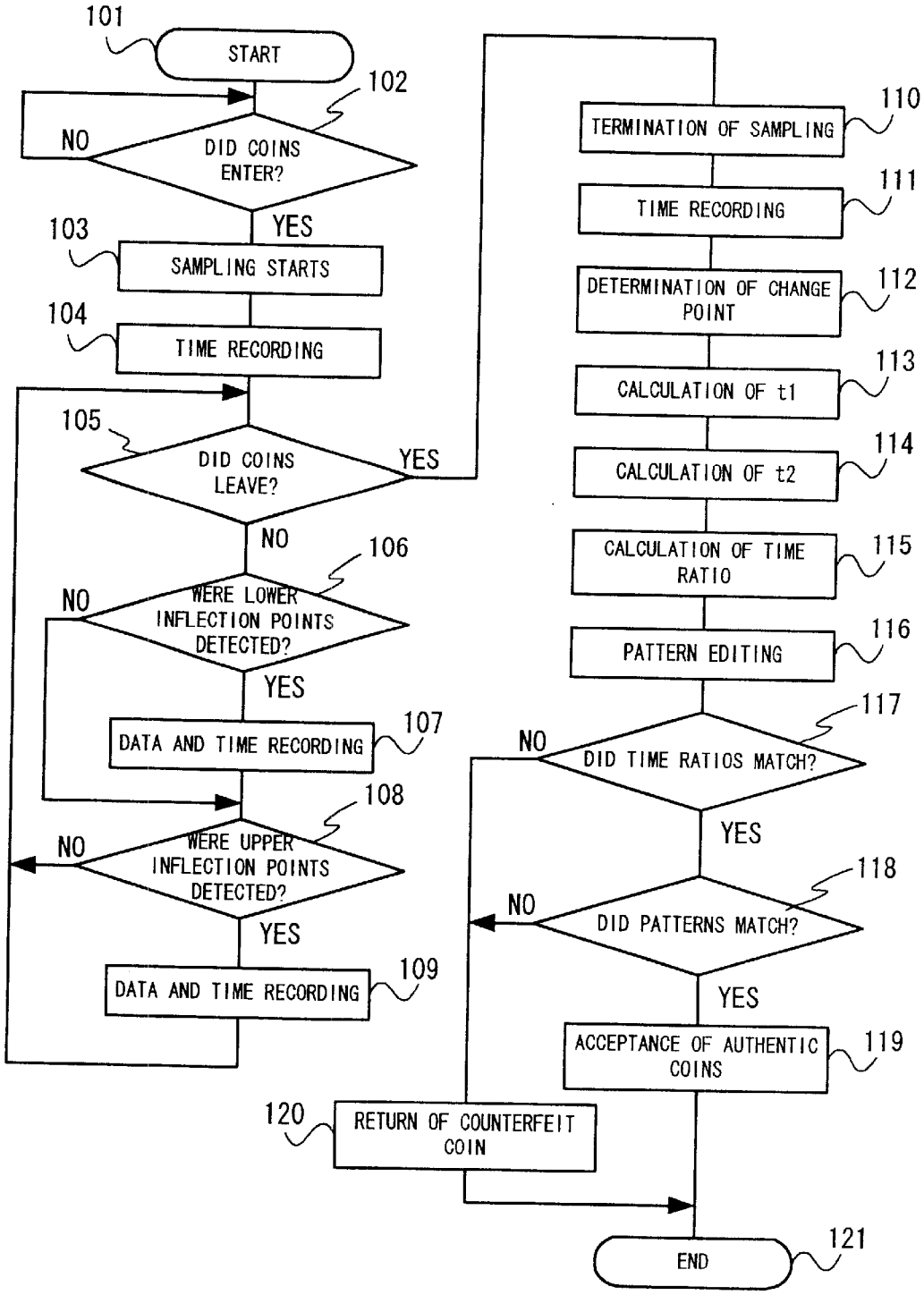
FIG. 4 is a flow chart showing a flow of data processing.

FIG. 4 shows a flow chart showing a flow of data processing.

The coin processing device 100 starts to operate (step 101). A coin slotted through the coin slotting part 2 is guided along the coin passage 7 to enter the sensor part 3 (YES in step 102). CPU 12 starts sampling of the detection output of the sensor part 3 (step 103) and also obtains time from the time measuring means 11 to store it in the memory 17 (step 104). When the detection output of the sensor part 3 becomes lower than a threshold (A point of FIG. 3(*a*)), it is Judged that the coin has entered the sensor part 3.

Subsequently, inflection points (P1, P3, P5, P7, P9 in FIG. 3(*a*)) of falling troughs and inflection points (P2, P4, P6, P8 in FIG. 3(*a*)) of rising crests are detected from the detection output being sampled until the coin leaves the sensor part 3 (NO in step 105). When the inflection points of falling troughs are detected (YES in step 106), data about the inflection points and the detection time are recorded in the memory 17 (step 107). When the inflection points of rising crests are detected (YES in step 108), data of the inflection points and the detection time are recorded in the memory 17 (step 109). These inflection points are detected by obtaining, as the inflection points, data as of the moments of change of the detection output from a decreasing (or increasing) direction to an increasing (or decreasing) direction.

Then, the coin leaves the sensor part 3 (YES in step 105), and the sampling of the detection output is terminated (step 110). And, time at the termination is obtained from the time measuring means 11 and stored in the memory 17 (step 111).

Subsequently, the points of change which have data of the detected inflection points compiled into five data as described above are determined (step 112, see FIG. 3(*b*)). This determination of the change points is made by determining the first inflection point P1 as first change point P1DT and the last inflection point P9 as fifth change point P5DT. Then, among the inflection points excluding the inflection points (P1, P9) determined as the first change point P1DT and the fifth change point P5DT, the inflection point P5 having the smallest value is determined as third change point P3DT. The first change point P1DT, the third change point P3DT and the fifth change point P5DT are data of protruded portions of the coin (inflection points of troughs), so that recessed portions of the coin are detected next. To figure out the recessed portions, the inflection point P4 having the largest value between the first change point P1DT and the third change point P3DT is determined as second change point P2DT, and the inflection point P8 having the largest value between the third change point P3DT and the fifth change point P5DT is determined as fourth change point P4DT. Among the five change points determined above, the first change point P1DT and the fifth change point P5DT are data used for evaluating the shapes (e.g., the presence or not of an edge, and a thickness of the edge) of the outer periphery of the coin, and the second change point P2DT, the third change point P3DT and the fourth change point P4DT are data used for evaluating the projections and depressions (pattern) of the coin.

Then, time t1 is calculated on the basis of the detection time of the inflection point P1 and the detection time of the inflection point P9 recorded in the memory 17 (step 113), and time t2 is calculated on the basis of the entrance time (A point of FIG. 3(*a*)) of the coin and the left time (B point of FIG. 3(*a*)) recorded in memory 17 (step 114). After time t1 and t2 are calculated, their time ratio t1/t2 is calculated (step 115). Variation in time depending on the speeds of coins traveling along the coin passage 7 can be absorbed by virtue of this time ratio, and the following processing can facilitated. And, the time ratio calculated here,namely, t1/t2, becomes small as the subject coin has a small edge thickness and a large difference between projections and depressions of the coin pattern.

Then, the first to fifth change points determined in step 112 are edited to have a basic pattern (step 116). In the basic patterning process, the values of the first change point P1DT and the fifth change point P5DT are compared, and when the value of the first change point P1DT is larger than the fifth change point P5DT, they are interchanged to arrange in increasing order of value. The values of the second change point P2DT and the fourth change point P4DT are compared, and when the value of the second change point P2DT is larger; they are interchanged. This basic patterning enables to obtain data not depending on the front or back of the entered coins or their entered timing.

The time ratio calculated in step 115 is compared with the judgment values (plural because the values are different for individual acceptable coins) stored in the judgment value storage means 16 (step 117), and when they match to each other (not required to match perfectly but allowed to match in a predetermined range of acceptable level) (YES in step 117), the basic pattern edited in step 116 is compared with a pattern stored in the judgment value storage means 16 (step 118). When they match to each other (not required to match perfectly but allowed to match in a predetermined range of acceptable level) (YES in step 118), the coin sorting Control means 15 controls the coin sorting part 4 so that the pertinent coin is accepted as the authentic coin by the coin acceptance part 6 (step 119), and the processing is terminated (step 121).

When one of the time ratio compared in step 117 and the base pattern compared in step 118 or both of them do not match to each other (NO in step 117, NO in step 118), the coin sorting control means 15 controls the coin sorting part 4 to return the pertinent coin as the counterfeit coin through the coin returning part 5 (step 120), and the processing is terminated (step 121).

In this embodiment, as the method of sorting coins, the edge position (the comparison of the time ratio in step 117 of FIG. 4) and the pattern (the comparison of the base pattern in step 118 of FIG. 4) of the coin are compared with the judgment values, but they are not required to be used together, and only one of them can be used to sort the coins and to identify them as authentic or counterfeit. The conventional method to detect the outer shape and material of a coin can be used to more accurately sort coins and identify them as authentic or counterfeit.

INDUSTRIAL APPLICABILITY

The present invention relates to a coin sorting method and a device for identifying coins as authentic or counterfeit by detecting patterns of slotted coins and comparing pattern detecting time with judgment values. This configuration can detect counterfeit coins such as foreign ones which have very similar material, outer shapes and patterns to authentic coins.

What is claimed is:

1. A coin sorting method in which a sensor is disposed on a coin passage, surface patterns of coins rolling through the coin passage are detected by the sensor, the coins are identified as authentic or counterfeit on the basis of the detected results, the coins identified as counterfeit by the identification are returned, characterized by:

measuring a surface pattern detection time during which the sensor detects the surface pattern of the coins;

comparing the measured surface pattern detection time with a predetermined time; and identifying the coins as authentic or counterfeit on the basis of the compared results.

2. The coin sorting method according to claim 1, wherein the output of the sensor is an output including change points which change from rising to falling and from falling to rising depending on a pattern of the coin, and surface pattern detection time is a time required between the detection of a first change point and the detection of a last change point among the change points.

3. The coin sorting method according to claim 1, wherein a ratio between a presence detection time during which the sensor detects the presence of the coin and the surface pattern detection time is calculated, and the coin is identified as authentic or counterfeit according to the compared result between the calculated value and predetermined judgment values.

4. A coin sorting device having a sensor disposed on a coin passage, which detects surface pattern of coins rolling through the coin passage by the sensor, identifies the coins as authentic or counterfeit on the basis of the detected results, accepts the coins identified as authentic by the identification and returns the coins identified as counterfeit by the identification, characterized in that the coin sorting device comprises:

comparison means for comparing the surface pattern detection time measured by the time measuring means with a predetermined time.

5. The coin sorting device according to claim 4, wherein the output of the sensor is an output including change points which change from rising to falling and from falling to rising depending on a pattern of the coin;

the feature sensing means detects the change points from the output of the sensor; and the time measuring means measures a time required between the detection of a first change point and the detection of a last change point among the change points by the feature sensing means.

6. The coin sorting device according to claim 4, further comprising time ratio calculation means for calculating a ratio between a presence detection time during which the sensor detects the presence of the coin and the feature detection time, wherein the comparison means compares a value calculated by the time ratio calculation means with predetermined judgment values.

* * * * *